US011525092B2

(12) United States Patent
Thayer et al.

(10) Patent No.: US 11,525,092 B2
(45) Date of Patent: Dec. 13, 2022

(54) PROCESS FOR EXTRACTING CRUDE OIL FROM SUBSTRATES

(71) Applicants: Ian Thayer, Vineyard, UT (US); Paul Thompson, Vernal, UT (US); Ronald Gago, Vernal, UT (US); Donald Clark, Staten Island, NY (US); Keith Azbill, Orem, UT (US)

(72) Inventors: Ian Thayer, Vineyard, UT (US); Paul Thompson, Vernal, UT (US); Ronald Gago, Vernal, UT (US); Donald Clark, Staten Island, NY (US); Keith Azbill, Orem, UT (US)

( * ) Notice: Subject to any disclaimer, the term of this patent is extended or adjusted under 35 U.S.C. 154(b) by 0 days.

(21) Appl. No.: 17/516,825

(22) Filed: Nov. 2, 2021

(65) Prior Publication Data

US 2022/0145187 A1 May 12, 2022

Related U.S. Application Data

(60) Provisional application No. 63/112,777, filed on Nov. 12, 2020.

(51) Int. Cl.

| | |
|---|---|
| ***C10G 1/04*** | (2006.01) |
| ***C10G 1/02*** | (2006.01) |
| ***C10G 1/00*** | (2006.01) |

(52) U.S. Cl.

CPC ..... *C10G 1/045* (2013.01); *C10G 1/002* (2013.01); *C10G 1/02* (2013.01)

(58) Field of Classification Search

CPC ..... C10G 1/002; C10G 1/02; C10G 1/045

See application file for complete search history.

(56) References Cited

U.S. PATENT DOCUMENTS

| | | | | |
|---|---|---|---|---|
| 1,908,616 | A | 1/1930 | Petty | |
| 3,415,738 | A | 12/1968 | Nicodimescu | |
| 8,790,509 | B2 | 7/2014 | Vu | |
| 2005/0279715 | A1* | 12/2005 | Strong | E21B 21/066 210/806 |
| 2011/0313218 | A1* | 12/2011 | Dana | C10B 53/06 208/400 |

* cited by examiner

*Primary Examiner* — Ellen M Mcavoy
*Assistant Examiner* — Chantel L Graham
(74) *Attorney, Agent, or Firm* — Michael C. Balaguy

(57) ABSTRACT

A process allows the extraction of heavy hydrocarbon compounds from solid substrates in an economical and efficient fashion. Materials containing heavy hydrocarbons (i.e. oil sands or roofing shingles) are broken up into an auger and then mixed with light hydrocarbons. Subsequently, the resulting slurry is shaken to separate fluids from solids, and the fluids are subjected to one or more filtering processes to remove waste sediment. These filtering processes may include a series of one or more of centrifuges and nozzle purifier machines. Filtered fluids are distilled to separate heavy hydrocarbons from light hydrocarbons. Simultaneously, the solids are heated to remove the remaining light hydrocarbons as vapors. Light hydrocarbons are cooled in a condenser and coalesced in a holding tank, wherefrom they may be recirculated into the process and used repeatedly. The now-isolated heavy hydrocarbons resulting from the distillation process may be removed as a purified product.

2 Claims, 2 Drawing Sheets

PROCESS FOR EXTRACTING CRUDE OIL FROM SUBSTRATES

CROSS-REFERENCE TO RELATED APPLICATION(S)

The present application is related to and claims priority to U.S. Provisional Patent Application No. 63/112,777 filed Nov. 12, 2020, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of hydrocarbon processing and more specifically relates to extraction of crude oils.

RELATED ART

Hydrocarbon compounds form the vast majority of fuel energy sources in modern industry. Accordingly, processing a wide variety of hydrocarbon types into purities suitable for combustion is a critical technology. However, the economic viability of such processing varies by hydrocarbon. In particular, a distinction is made between "light" hydrocarbons (typically defined as having API gravity over 20°) and "heavy" hydrocarbons (having API gravity less than 20°). Generally, "light" hydrocarbons are more valuable and are also easier to process and transport due to their flow characteristics. "Heavy" hydrocarbons (i.e. crude oil) present problems in processing and transportation since they do not flow easily. Since heavy hydrocarbons are also worth less, purifying heavy hydrocarbons is disincentivized in the industry. If heavy hydrocarbons can be purified, they can be subjected to cracking processes to convert the long-chain hydrocarbon molecules into more useful forms, generally by use of catalysts. However, it is the purification of heavy hydrocarbons prior to reaching this stage which is of particular difficulty.

This disincentivization of purifying heavy hydrocarbons is problematic for two primary reasons. First, this leaves an untapped source of profit, especially when light hydrocarbons and heavy hydrocarbons are harvested together in the same extraction process. Second, heavy hydrocarbons can be a detriment to the environment when left as waste product. Examples may include naturally or artificially occurring oil-saturated soils, asphalt roof shingles, aqueous oil spills, and bitumen from degrading or deconstructed roadways. Accordingly, there is seen a need to develop a practical and economically viable process for purifying crude oil out of solid substrates.

Various attempts have been made to solve problems found in the oil processing art. Among these are found in U.S. Pat. Nos. 3,415,738, 1,908,616, and 8,790,509. This prior art is representative of processes for purifying heavy hydrocarbons.

None of the above inventions and patents, taken either singly or in combination, is seen to describe the invention as claimed. Thus, a need exists for a reliable process for extracting crude oil from substrates, and to avoid the above-mentioned problems.

SUMMARY OF THE INVENTION

In view of the foregoing disadvantages inherent in the known hydrocarbon processing art, the present disclosure provides a novel process for extracting crude oil from substrates. The general purpose of the present disclosure, which will be described subsequently in greater detail, is to provide a process for extracting crude oil from substrates.

The process allows the extraction of heavy hydrocarbon compounds from solid substrates in an economical and efficient fashion. Materials containing heavy hydrocarbons (i.e. oil sands or roofing shingles) are broken up into an auger and then mixed with light hydrocarbons. Subsequently, the resulting slurry is shaken to separate fluids from solids, and the fluids are subjected to one or more filtering processes to remove waste sediment. These filtering processes may include a series of one or more of centrifuges and nozzle purifier machines. Filtered fluids are distilled to separate heavy hydrocarbons from light hydrocarbons. Simultaneously, the solids are heated to remove the remaining light hydrocarbons as vapors. Light hydrocarbons are cooled in a condenser and coalesced in a holding tank, wherefrom they may be recirculated into the process and used repeatedly. The now-isolated heavy hydrocarbons resulting from the distillation process may be removed as a purified product.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a process for extracting crude oil from substrates, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a hydrocarbon separation process and more particularly to a process for extracting crude oil from substrates as used to improve the efficiency of harvesting heavy hydrocarbons.

Figure 1:
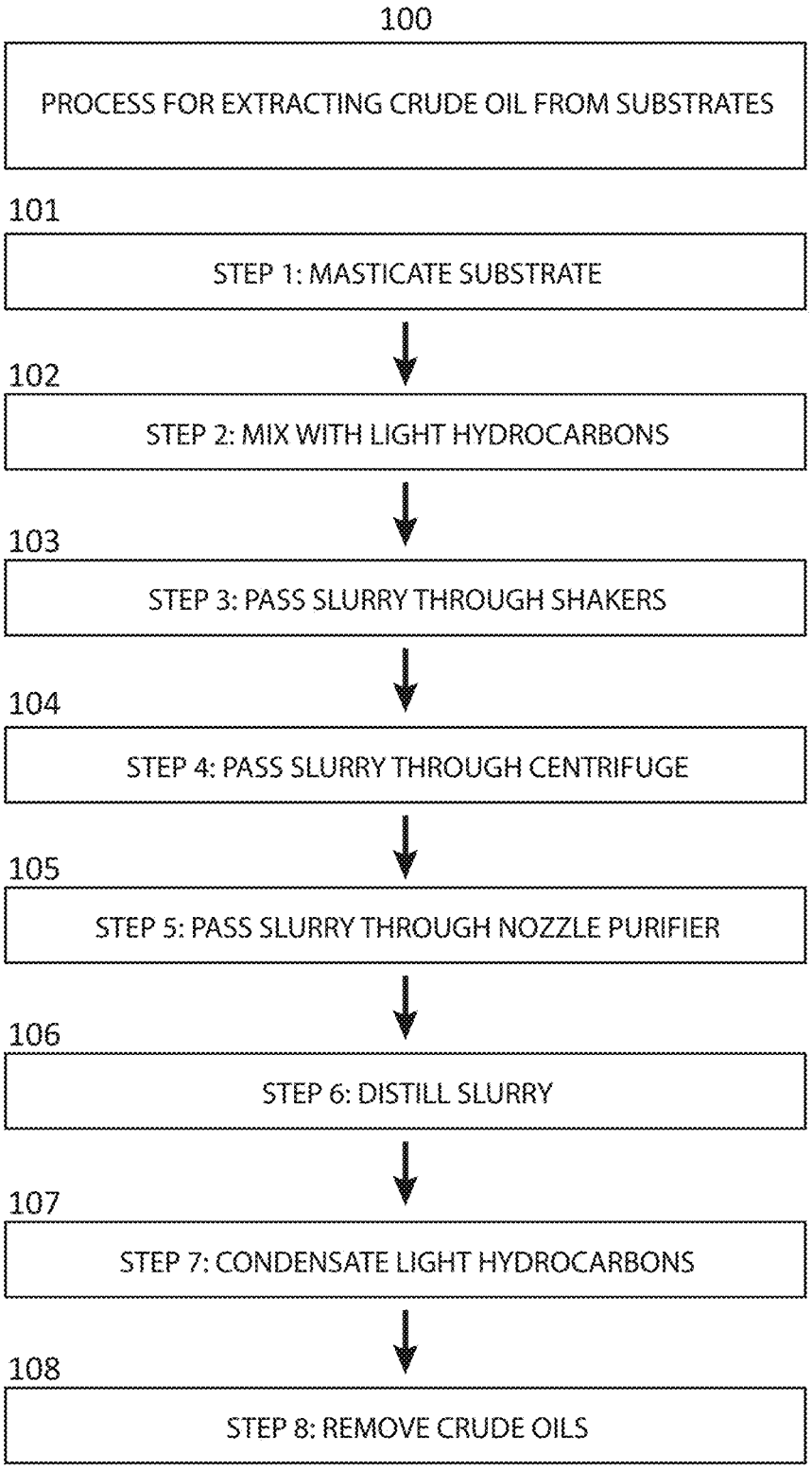
FIG. 1 is a flow chart illustrating a process for extracting crude oil from substrates.

Generally, the process may be divided into a number of distinct steps. FIG. 1 shows an extraction process according to an embodiment of the present disclosure.

Step 1 (101): Initial contaminated hydrocarbons (the object of the process) are added to an auger (specifically, a feed-auger). The auger may be used to break up the material feed. In some instances, more solid material (such as bitumen or roofing shingles) may require more aggressive deconstruction. The auger further acts as a barrier for vapors during this process. Augers may be slightly heated in some embodiments; however, heating is not a primary process at this stage.

Step 2 (102): The contaminated hydrocarbons are added to a mixing tank. Light hydrocarbons are added to the mixing tank via injection nozzles. The lights serve to increase API and flowability, and also act as a solvent to remove heavy oil from the solid substrate. Nitrogen purge occurs to displace oxygen in the tank. (Nitrogen may be generated from atmosphere in auxiliary process.) Additionally, a vacuum may pull evaporate fumes into a vapor recovery system. Slight warming may occur to improve flow characteristics.

Step 3 (103): This slurry (of contaminated hydrocarbons and added lights) pass through shakers to remove waste particulates. Resolution of the shakers may range from 50 to 300 mesh API as desired for a particular process application by the end user. Separated fluids pass down into shakers to be passed to the decanter centrifuge. Waste solids still containing some hydrocarbons pass over shakers and directly into the distillation chamber. Repeated nitrogen purging.

Step 4 (104) (optional): Fluids passes through centrifuge to further remove waste particulates. Recommended minimum centrifugal force is 2500 G's. Preferably, this is a decanter type centrifuge.

Step 5 (105) (optional) Nozzle machine further removes waste particulates from the fluids. This step will generally be used if the contaminate content (contaminants being basic solids and water, or BS&W) is still over one percent of total mass. In some embodiments, a holding tank may be placed between steps 4 and 5 where this ratio can be determined for quality control.

Step 6: (106) Fluids from holding tank following the centrifuge and the nozzle machine enter distillation system. Meanwhile, solids from the shakers are heating in augers. Heating is critical at this stage to remove light hydrocarbons as vapors. Heating in one embodiment may be approximately 500 to 650 degrees Fahrenheit. Nitrogen may be applied to purge oxygen. Solids are discarded following this step.

Step 7: (107) Light hydrocarbons are removed from the heated augers and cooled in a condenser. Condenser may use a glycol chiller or a fin fan cooler. Lights are also collected from the distillation column. The now re-liquified lights may be recirculated into Step 2 with a new batch of raw product to participate in the refining process repeatedly. In order to continually provide light hydrocarbons to an automated process, a storage tank collects and stores re-liquified lights between the condenser and the mixer in Step 2. Examples of light hydrocarbons able to be removed and condensed in this way include natural gas condensate and naphtha, and generally any hydrocarbon in the range of 45 to 65 API.

Step 8: (108) The isolates, the now purified heavy hydrocarbons (i.e. crude oil, etc.), may be removed from the distillation column as product.

Figure 2:
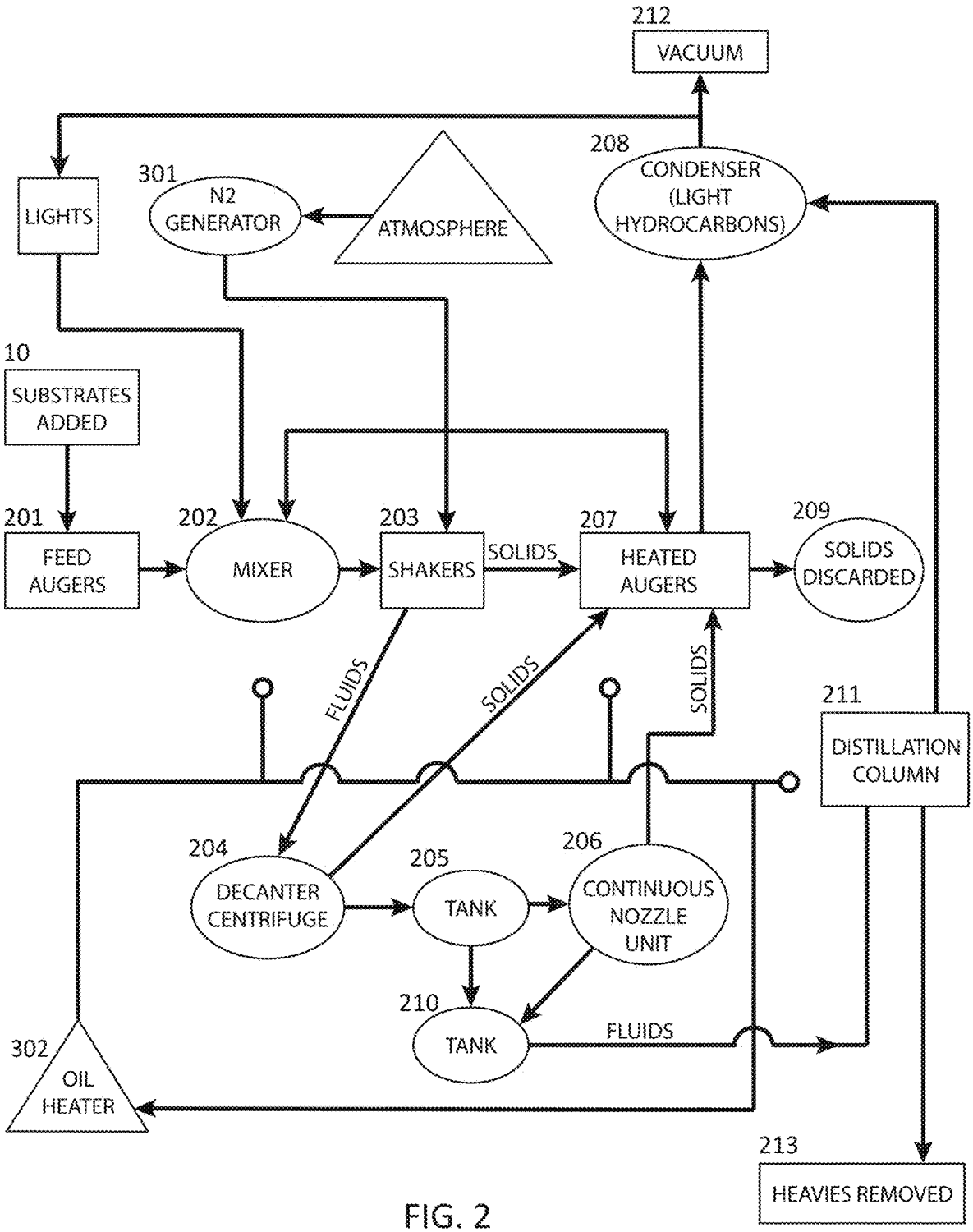
FIG. 2 is chart illustrating the process for extracting crude oil from substrates and the interaction of auxiliary systems according to an embodiment of the present invention.

FIG. 2 is a flowchart illustrating the extraction process of FIG. 1, according to an embodiment of the present disclosure. This figure illustrates a process flow including auxiliary processes. As before, the process begins when substrates to be purified enter augers 201. Masticated substrates enter mixing chamber 202, where light hydrocarbons are added and a nitrogen purge occurs. As illustrated, it is here that nitrogen is injected from nitrogen generator 301. Nitrogen generator may harvest nitrogen directly from the atmosphere, such as via fractional distillation or any other practical method. Nitrogen purging may also occur in shakers 203 and heater augers 207. From mixing chamber 202, the slurry of substrate and light hydrocarbons passes into shakers 203. Here, fluids pass down through the shakers and move on to centrifuge 204, storage tank 205, and nozzle machine 206, reaching secondary tank 210 in a decontaminated form. Hydrocarbons pass from tank 210 into distillation column 211, separating light hydrocarbons which can be vaporized from heavy hydrocarbons. In some embodiments, some of these steps (generally either 206, or 204-206) may be skipped if such extensive purification is not necessary. Meanwhile, the solids pass from shakers 203 into heated augers 207. Preferably, heated augers move material for a minimum of 40 feet. Heated augers 207 separate vaporized hydrocarbons from the solids. Heat is applied (preferably to a climax of between 500- and 650-degrees Fahrenheit) to remove light hydrocarbons as vapors. From here, vapors enter condenser 208, where condensation occurs to return the light hydrocarbons to a liquid form. Light hydrocarbons from distillation column 211 also collect in condenser 208. Vacuum 212 provides the force to draw light hydrocarbon vapors into condenser 208. These condensates may be stored in a holding chamber feeding mixing chamber 202. Purified heavy hydrocarbons may be removed from distillation stage 211 as a final product and collected in holding tank 213. Concurrently, oil heater 302 may operated in a closed circuit, with passages in contact with augers 201 and distillation stage 207 for heating purposes.

Some auxiliary systems may be implemented. Firstly, an oil heater may heat a process oil to 650 degrees Fahrenheit and circulate oil in contact with the augers and distillation system to heat these components of the system process. A vacuum pump may operate to pull vapors from both the augers and shaker enclosure to add these to the condenser (in addition to those removed from the distillation stage). Lastly, a nitrogen generator may produce purge gas to use in the augers.

The exact specifications, materials used, and method of use of the process for extracting crude oil from substrates may vary upon manufacturing. Additional steps may be implemented where necessary for varying input products, output goals, environmental factors, etc.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An extraction process for separating crude oil from substrates comprising:

masticating a solid substrate in one or more feed-augers, the solid substrate containing heavy hydrocarbons, the heavy hydrocarbons having an API of less than 21;

passing the solid substrate into a mixing chamber;

adding light hydrocarbons to the mixing chamber, the light hydrocarbons having an API of more than 45, such that the light hydrocarbons, the heavy hydrocarbons, and solid particulates together form a slurry;

purging the mixing chamber of oxygen by injecting nitrogen into the mixing chamber;

passing the slurry through one or more shakers to separate the slurry into solids and fluids;

passing the solids through one or more heated-augers to vaporize and remove the remaining light hydrocarbons;

passing the fluids through one or more of a centrifuge and a nozzle purifier to remove solid particulates from the fluids;

passing the fluids into a distillation stage;

applying heat to the distillation stage to vaporize the light hydrocarbons;

removing the light hydrocarbons from the one or more heated-augers and the distillation stage to a condenser;

condensing the light hydrocarbons to a liquid state;

reinjecting the light hydrocarbons into the mixing chamber;

removing the heavy hydrocarbons from the distillation stage as a purified product having less than one percent of solid particulates.

2. The extraction process of claim 1 with the additional step of discarding the solids remaining in the one or more heated-augers after the heavy hydrocarbons have been removed from the distillation stage.

* * * * *